US009725258B2

(12) United States Patent
Ichikawa et al.

(10) Patent No.: US 9,725,258 B2
(45) Date of Patent: Aug. 8, 2017

(54) IMAGE FORMING DEVICE

(71) Applicant: Konica Minolta, Inc., Chiyoda-ku, Tokyo (JP)

(72) Inventors: Katuhisa Ichikawa, Chiryu (JP); Yoshiki Matsui, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/221,793

(22) Filed: Jul. 28, 2016

(65) Prior Publication Data

US 2017/0052486 A1 Feb. 23, 2017

(30) Foreign Application Priority Data

Aug. 17, 2015 (JP) ..... 2015-160280

(51) Int. Cl.
*G03G 15/00* (2006.01)
*B65H 1/00* (2006.01)
*G03G 21/16* (2006.01)

(52) U.S. Cl.
CPC ..... *B65H 1/00* (2013.01); *G03G 15/6511* (2013.01); *G03G 21/1647* (2013.01); *G03G 2221/1657* (2013.01)

(58) Field of Classification Search
CPC ..... B65H 7/00
USPC ..... 399/391
See application file for complete search history.

(56) References Cited

U.S. PATENT DOCUMENTS 4,977,428 A * 12/1990 Sakakura ..... G03G 15/0822 310/198
5,842,694 A * 12/1998 Brooks ..... B65H 1/14 271/110
2006/0051134 A1* 3/2006 Ahn ..... G03G 15/0121 399/222
2007/0177899 A1* 8/2007 Kawamura ..... G03G 15/0121 399/223
2008/0211176 A1* 9/2008 Miura ..... G03G 15/65 271/264
2008/0226345 A1* 9/2008 Yoon ..... G03G 21/1676 399/167

(Continued)

FOREIGN PATENT DOCUMENTS

JP 58-212537 A 12/1983

*Primary Examiner* — Anthony Nguyen
(74) *Attorney, Agent, or Firm* — Buchanan Ingersoll & Rooney PC

(57) ABSTRACT

An image forming device includes: a conveyance unit; an image forming section; a plurality of storage units; and a sheet feeding roller, wherein provided are: one drive source; a first drive transmission system including a first one-way clutch; a second drive transmission system including: a second one-way clutch; and a first transmission interrupting unit; a third drive transmission system including: a third one-way clutch; and a second transmission interrupting unit; and a control unit, and the control unit is configured to: rotationally drive the drive source in the first direction at the time of the sending operation by the first sheet feeding roller; rotationally drive the drive source in the second direction at the time of the sending operation by the second sheet feeding roller; and rotationally drive the drive source in the second direction at the time of the sending operation by the third sheet feeding roller.

8 Claims, 7 Drawing Sheets

(56) References Cited

U.S. PATENT DOCUMENTS

2014/0320877 A1* 10/2014 Kaneko ..... G06K 15/16
358/1.13

* cited by examiner

FIG. 4

| | SHEET FEEDING ROLLER TO PERFORM SENDING OPERATION | | |
|---|---|---|---|
| | FIRST SHEET FEEDING ROLLER | SECOND SHEET FEEDING ROLLER | THIRD SHEET FEEDING ROLLER |
| MOTOR | FIRST DIRECTION | SECOND DIRECTION | SECOND DIRECTION |
| FIRST ONE-WAY CLUTCH | CONNECTED | DISCONNECTED | DISCONNECTED |
| SECOND ONE-WAY CLUTCH | DISCONNECTED | CONNECTED | CONNECTED |
| FIRST ELECTROMAGNETIC CLUTCH | DISCONNECTED | CONNECTED | DISCONNECTED |
| THIRD ONE-WAY CLUTCH | DISCONNECTED | CONNECTED | CONNECTED |
| SECOND ELECTROMAGNETIC CLUTCH | DISCONNECTED | DISCONNECTED | CONNECTED |

IMAGE FORMING DEVICE

The entire disclosure of Japanese Patent Application No. 2015-160280 filed on Aug. 17, 2015 including description, claims, drawings, and abstract are incorporated herein by reference in its entirety.

BACKGROUND OF THE INVENTION

Field of the Invention

The present invention relates to an image forming device. More specifically, the present invention relates to an image forming device including a plurality of storage units to store sheets in a loading manner.

Description of the Related Art

In an image forming device, a sheet is fed from a sheet feeding unit to an image forming unit, and an image is formed on the sheet by the image forming section. The sheet feeding unit is provided with a storage unit adapted to store a plurality of sheets in a loading manner and a sheet feeding roller adapted to perform sending operation to send out the sheets from the storage unit. The sheet feeding unit sends, to a conveyance route, a topmost sheet out of the plurality of sheets stored in the storage unit in a loading manner by sending operation of the sheet feeding roller at the time of image forming, and feeds the sheet to the image forming section.

Additionally, for example, an image forming device or the like which can perform image forming on plural types of sheets may include a plurality of storage units and sheet feeding rollers in the sheet feeding unit. Furthermore, at the time of image forming, a sheet feeding roller for one storage unit out of the plurality of storage units is made to perform sending operation, thereby sending the sheet from the storage unit for which the sheet feeding roller performs the sending operation. As a technology in a related art related to such an image forming device is disclosed in, for example, JP 58-212537-A.

In JP 58-212537-A, an image forming device including three storage units is disclosed. Additionally, two motors are provided in order to drive respective sheet feeding rollers of the three storage units. More specifically, the respective sheet feeding rollers for two storage units out of the three storage units are connected to a first common motor by a drive transmission system including a one-way clutch. The sheet feeding roller of the other storage unit is connected to a second motor different from the first motor by the drive transmission system.

By the way, in an above-described related art, a space occupied by motors inside an image forming device is large because the number of the motors to be drive sources is many. Also, since the number of the motor is many, manufacturing cost for the image forming device is increased. In other words, it is preferable to have the less number of drive sources to drive a sheet feeding roller in the viewpoints of space saving and cost reduction. Additionally, in order to make respective three sheet feeding rollers perform the sending operation by one motor, it is necessary to provide a component such as an electromagnetic clutch which can control to switch between transmission and interruption of power.

Furthermore, the sending operation by the sheet feeding roller is constantly performed at the time of image forming. Therefore, preferably, sound generated with the sending operation is minimized as much as possible in order to improve peripheral environment of the image forming device. However, there may be problem in which sliding sound is quite loud, for example, in an electromagnetic clutch at the time of idling due to being set to an interruption state.

SUMMARY OF THE INVENTION

The present invention has been made to solve problems included in the related art described above. More specifically, an object of the present invention is to provide an inexpensive and compact image forming device in which sound generated with sending operation is reduced.

To achieve the abovementioned object, according to an aspect, an image forming device reflecting one aspect of the present invention comprises: a conveyance unit configured to convey a sheet along a conveyance route; an image forming section configured to form an image on a sheet conveyed along the conveyance route; a plurality of storage units configured to store a plurality of sheets in a loading manner; and a sheet feeding roller provided in each of the plurality of storage units and configured to perform sending operation to send, to the conveyance route, the sheets stored in the storage unit one by one at the time of image forming, wherein provided are: one drive source configured to be rotated in a first direction or a second direction opposite to the first direction by receiving power supply, and generate drive force to rotationally drive the sheet feeding roller by own rotation of the drive source; a first drive transmission system configured to connect the drive source to a first sheet feeding roller for a first storage unit out of the storage units by using a mechanical element that transmits drive force generated from the drive source, and as the mechanical element, including a first one-way clutch that transmits only drive force in the first direction of the drive source; a second drive transmission system configured to connect the drive source to a second sheet feeding roller for a second storage unit out of the storage units by using the mechanical elements, and as the mechanical elements, including: a second one-way clutch that transmits only drive force in the second direction of the drive source; and a first transmission interrupting unit arranged more on the second sheet feeding roller side than the second one-way clutch is and configured to set a transmission state to transmit drive force or an interruption state not to transmit drive force by performing on/off operation of power supply; a third drive transmission system configured to connect the drive source to a third sheet feeding roller for a third storage unit out of the storage units by using the mechanical element, and as the mechanical element, including: a third one-way clutch that transmits only drive force in the second direction of the drive source; and a second transmission interrupting unit arranged more on the third sheet feeding roller side than the third one-way clutch is and configured to set a transmission state to transmit drive force or an interruption state not to transmit drive force by performing on/off operation of power supply; and a control unit configured to determine the sheet feeding roller to perform the sending operation at the time of image forming and control the drive source, the first transmission interrupting unit, and the second transmission interrupting unit, and the control unit is configured to: rotationally drive the drive source in the first direction at the time of making the first sheet feeding roller perform the sending operation; rotationally drive the drive source in the second direction while setting the first transmission interrupting unit in the transmission state and setting the second transmission interrupting unit in the interruption state at the time of making the second sheet feeding roller perform the sending operation; and rotationally drive the drive source in the second direction while setting the first transmission interrupting unit in the interruption state and setting the second transmission interrupting unit in the transmission state at the time of making the third sheet feeding roller perform the sending operation.

In the image forming device according to the abovementioned aspect of the present invention, since the number of the drive source is one, the image forming device is more inexpensive and a space occupied by the drive source inside the device can be formed smaller than the case where a plurality of drive sources is provided. Furthermore, when the first sheet feeding roller performs the sending operation, drive force is prevented from being transmitted to the first transmission interrupting unit and the second transmission interrupting unit. Therefore, when the first sheet feeding roller performs the sending operation, sound generated from the first transmission interrupting unit and the second transmission interrupting unit can be suppressed although these transmission interrupting units tend to be sources of sound. In other words, the sound generated in the case of forming an image on a sheet stored in the first storage unit is reduced. More specifically, the image forming device is inexpensive and compact, and the sound generated with the sending operation is reduced.

According to the abovementioned image forming device, the first storage unit is preferably arranged at a position in which a distance on the conveyance route to an image forming position where an image is formed on a sheet by the image forming section is shorter than distances to the image forming position from the second storage unit and the third storage unit. The reason is that image forming on the sheet stored in the first storage unit can be performed with high productivity while sound generation is reduced.

According to the abovementioned image forming device, the first drive transmission system is preferably formed of the less number of the mechanical elements than the second drive transmission system and the third drive transmission system are. The reason is that sound generated at the time of image forming on the sheet stored in the first storage unit can be more reduced.

According to the abovementioned image forming device, the second one-way clutch of the second drive transmission system is preferably arranged at a position closest to the drive source, and the third one-way clutch of the third drive transmission system is preferably arranged at a position closest to the drive source. The reason is that sound generated at the time of image forming on the sheet stored in the first storage unit can be more reduced.

According to the abovementioned image forming device, the first one-way clutch of the first drive transmission system is preferably arranged at a position closest to the drive source. The reason is that sound generated at the time of image forming on the sheets stored in the second storage unit and the third storage unit can also be reduced.

According to the abovementioned image forming device, the third one-way clutch of the third drive transmission system is preferably commonly used as the second one-way clutch of the second drive transmission system. The reason is that since the number of the one-way clutches is few, the cost is inexpensive and a space occupied by the one-way clutches inside the device can be formed small. Furthermore, the reason is that since the number of the one-way clutches is few, sound generated with rotation thereof can be reduced.

According to the abovementioned image forming device, the first storage unit is preferably provided inside the device, and at least one of the second storage unit and the third storage unit is preferably provided in a manner projecting outside the device. In the storage unit provided in a manner projecting outside the device, a sheet used with low frequency in image forming tends to be stored. On the other hand, a sheet used with high frequency in image forming tends to be stored in the storage unit provided inside the device. The reason is that sound generated in frequently-performed image forming can be reduced by storing the sheet used with high frequency in image forming in the first storage unit.

According to the abovementioned image forming device, the image forming device preferably includes a sheet type output unit configured to output a type of a sheet stored in the first storage unit and a type of a sheet stored in at least one of the second storage unit and the third storage unit, and the control unit preferably makes the first sheet feeding roller perform the sending operation when both a type of a sheet stored in the first storage unit and a type of a sheet stored in at least one of the second storage unit and the third storage unit output from the sheet type output unit are the same as a type of a sheet used in image forming. The reason is that the sound generated at the time of image forming can be more reduced than the case of making the second sheet feeding roller or the third sheet feeding roller perform the sending operation.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4 is a table illustrating control processing of a motor and electromagnetic clutches at the time of making the respective sheet feeding rollers perform sending operation;

DESCRIPTION OF THE PREFERRED EMBODIMENTS

Hereinafter, an embodiment of the present invention will be described in detail with reference to the drawings. However, the scope of the invention is not limited to the illustrated examples.

First Embodiment

Figure 1:
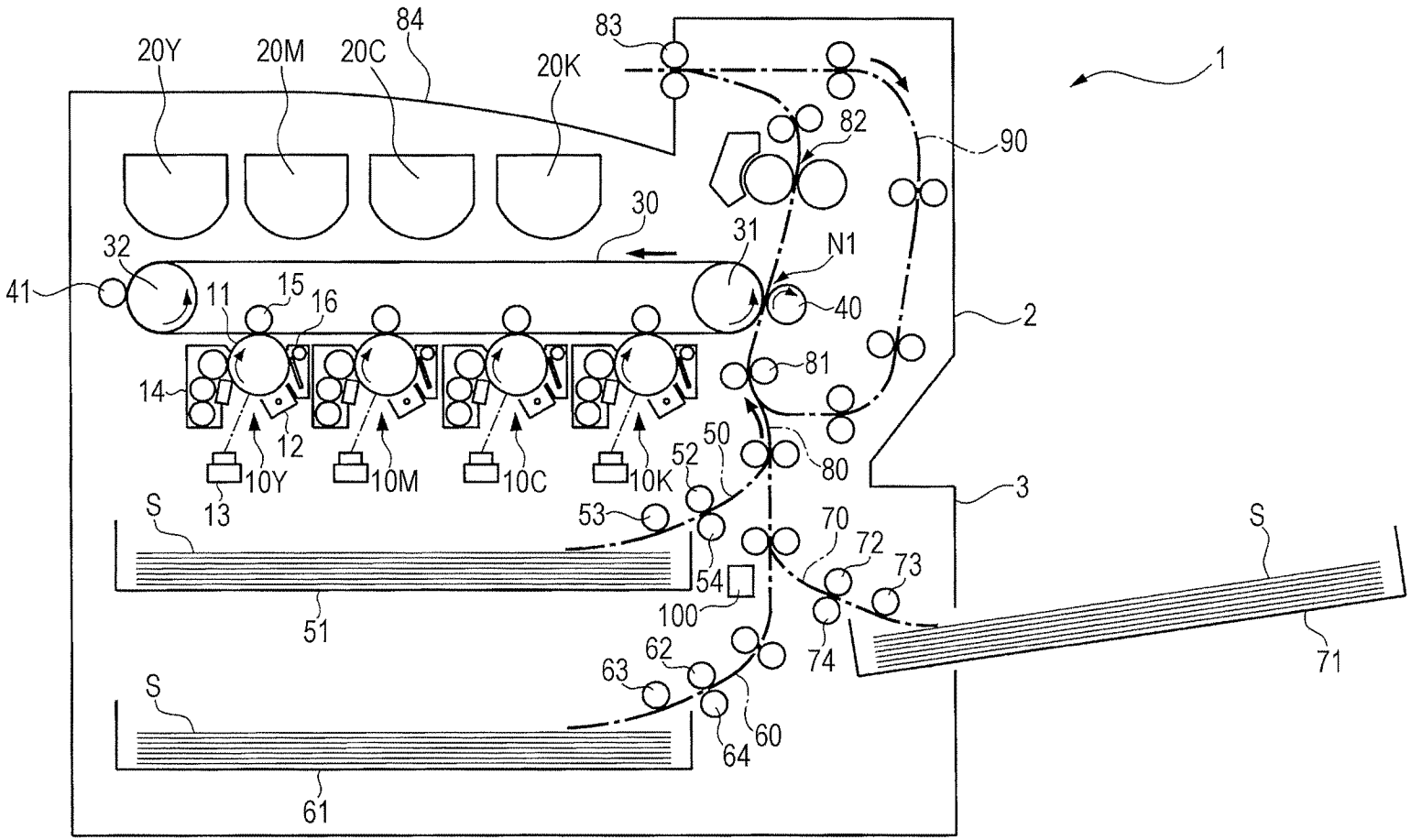
FIG. 1 is a schematic structural diagram illustrating an image forming device according to an embodiment of the present invention.

FIG. 1 is a schematic structural diagram illustrating an image forming device 1 according to the present embodiment. The image forming device 1 is a so-called tandem color printer including an intermediate transfer belt 30 inside an image forming section 2. The intermediate transfer belt 30 is an endless belt member having conductivity, and has both end portions supported by rollers 31, 32 in FIG. 1. At the time of image forming, the roller 31 on a right side of FIG. 1 is rotationally driven anticlockwise as indicated by an arrow in the drawing. Consequently, the intermediate transfer belt 30 and the roller 32 on a left side of FIG. 1 are respectively driven and rotated in directions indicated by arrows in the drawing.

A secondary transfer roller 40 is provided on an outer peripheral surface of a portion supported by the roller 31 on the right side of FIG. 1 out of the intermediate transfer belt 30. The secondary transfer roller 40 contacts the intermediate transfer belt 30 in a pressing manner in a direction orthogonal to a shaft (left direction in FIG. 1). A portion where the intermediate transfer belt 30 contacts the secondary transfer roller 40 is formed with a secondary transfer nip N1 adapted to transfer a toner image formed on the intermediate transfer belt 30 to a sheet S. At the time of image forming, the secondary transfer roller 40 is driven and rotated in a direction indicated by an arrow in FIG. 1 due to frictional force generated by the secondary transfer roller contacting the rotated intermediate transfer belt 30 in a pressing manner.

Additionally, a belt cleaner 41 is provided on the outer peripheral surface of a portion supported by the roller 32 on the left side of FIG. 1 out of the intermediate transfer belt 30. The belt cleaner 41 of the present embodiment can collect toner adhering to the surface of the intermediate transfer belt 30. In other words, the belt cleaner 41 can collect transfer residual toner not transferred to the sheet S at the secondary transfer nip N1.

Image forming units 10Y, 10M, 10C, 10K of respective colors of yellow (Y), magenta (M), cyan (C), and black (K) are sequentially arranged from left to right at a lower portion of the intermediate transfer belt 30 of the image forming section 2 in FIG. 1. All of the image forming units 10Y, 10M, 10C, 10K are adapted to form toner images of corresponding colors and transfer the toner images onto the intermediate transfer belt 30. All of the image forming units 10Y, 10M, 10C, 10K have the same structures. Therefore, in FIG. 1, only the image forming unit 10Y is indicated with the reference sign as a representative.

Each of the image forming units 10Y, 10M, 10C, 10K includes a photoconductor 11 that is a cylindrical-shaped electrostatic latent image bearer, a charging device 12 arranged around the photoconductor, an exposure device 13, a developing device 14, a primary transfer roller 15, and a photoconductor cleaner 16. The charging device 12 is adapted to uniformly charge a surface of the photoconductor 11. The exposure device 13 is adapted to irradiate the surface of the photoconductor 11 with laser light based on image data of the corresponding color, and form an electrostatic latent image. The developing device 14 is adapted to apply contained toner to the surface of the photoconductor 11.

The primary transfer roller 15 is arranged in a position facing the photoconductor 11 interposing the intermediate transfer belt 30. The primary transfer roller 15 contacts the intermediate transfer belt 30 in a pressing manner in a direction orthogonal to a shaft (downward direction in FIG. 1). Due to this contact in a pressing manner, a primary transfer nip adapted to transfer a toner image of each color formed on the photoconductor 11 onto the intermediate transfer belt 30 is formed at a portion where the intermediate transfer belt 30 contacts the photoconductor 11. The photoconductor cleaner 16 is adapted to collect the toner not transferred onto the intermediate transfer belt 30 from the photoconductor 11.

Meanwhile, a component that is plate-shaped and has one end portion contacting the outer peripheral surface of the photoconductor 11 is illustrated as the photoconductor cleaner 16 in FIG. 1, but the present invention is not limited thereto. Other cleaning members such as a fixed brush, a rotary brush, a roller, or a component combining a plurality of these members can be used. Alternatively, in the case of adopting a cleanerless system in which toner not transferred and remaining on the photoconductor 11 is collected by the developing device 14, the photoconductor cleaner 16 is not necessary.

Additionally, above the intermediate transfer belt 30 in FIG. 1, hoppers 20Y, 20M, 20C, 20K containing toner of respective colors are arranged. The toner of each color contained therein is suitably supplied to the developing device 14.

The image forming device 1 of the present embodiment includes a first storage unit 51, a second storage unit 61, and a third storage unit 71 in a sheet feeding unit 3 located below the image forming section 2. In the first storage unit 51, second storage unit 61, and third storage unit 71, sheets S are respectively stored in a loading manner. Both the first storage unit 51 and the second storage unit 61 are sheet feeding cassettes provided inside the image forming device 1. On the other hand, the third storage unit 71 is a manual feed tray provided in a manner projecting outside the image forming device 1.

Furthermore, as illustrated in FIG. 1, sheet feeding routes 50, 60 adapted to send the sheets S are respectively provided on the right side of the first storage unit 51 and the second storage unit 61 in FIG. 1. A sheet feeding route 70 adapted to send the sheet S is provided on the left side of the third storage unit 71 in FIG. 1.

Additionally, in the sheet feeding unit 3, a first sheet feeding roller 52, a first pickup roller 53, and a first separating roller 54 are provided in order to sequentially send the sheets S stored in the first storage unit 51 one by one starting from a topmost sheet thereof to the sheet feeding route 50. Furthermore, a second sheet feeding roller 62, a second pickup roller 63, and a second separating roller 64 are provided in order to sequentially send the sheets S stored in the second storage unit 61 one by one starting from a topmost sheet thereof to the sheet feeding route 60. Moreover, a third sheet feeding roller 72, a third pickup roller 73, and a third separating roller 74 are provided in order to send the sheets S stored in the third storage unit 71 one by one starting from a topmost sheet thereof to the sheet feeding route 70.

More specifically, the first sheet feeding roller 52 performs sending operation by being rotationally driven at the time of sending the sheet S from the first storage unit 51 to the sheet feeding route 50. The first pickup roller 53 conveys the sheet S to the first sheet feeding roller 52 by being rotationally driven while contacting the topmost sheet S of the first storage unit 51 when the first sheet feeding roller 52 performs the sending operation. The first separating roller 54 is a roller attached with a torque limiter provided in a manner facing the first sheet feeding roller 52. Furthermore, in the event of overlap feeding in which a plurality of sheets S is conveyed by the first pickup roller 53, the first separating roller 54 is adapted to convey only the topmost sheet to the sheet feeding route 50 by the sending operation of the first sheet feeding roller 52.

The second sheet feeding roller 62, second pickup roller 63, and second separating roller 64 of the second storage unit 61, and the third sheet feeding roller 72, third pickup roller 73, and third separating roller 74 of the third storage unit 71 are also adapted in the same way respectively as the first storage unit 51. Additionally, a downstream side in a conveyance direction of the sheets S in each of the sheet feeding routes 50, 60, 70 is connected to an image forming route 80. In other words, the sheet S fed in the sheet feeding unit 3 is designed to be conveyed to the image forming route 80.

Furthermore, the sheet feeding unit 3 is provided with a motor 100 adapted to generate drive force to rotationally drive the first sheet feeding roller 52, second sheet feeding roller 62, and third sheet feeding roller 72. In the image forming device 1 of the present embodiment, a drive source to drive the first sheet feeding roller 52, second sheet feeding roller 62, and third sheet feeding roller 72 is only one, the motor 100. Therefore, the image forming device 1 is inexpensive and compact.

Moreover, the motor 100 can make rotation in either a first direction or a second direction opposite to the first direction. Furthermore, among the first sheet feeding roller 52, second sheet feeding roller 62, and third sheet feeding roller 72, only one sheet feeding roller which performs the sending operation for the sheet S used in image forming is rotationally driven by drive force generated from the motor 100. This will be described later.

Additionally, a pair of registration rollers 81, the secondary transfer nip N1, a fixing device 82, and a sheet ejection roller 83 are arranged in this order on the image forming route 80. On the more downstream side of the image forming route 80, a sheet ejection unit 84 adapted to eject the sheet S completed with image forming is provided. The registration roller 81 is adapted to precisely adjust timing to send the sheet S to the secondary transfer nip N1. The fixing device 82 is adapted to perform fixing processing of a toner image transferred to the sheet S by heating and pressurizing the sheet S.

Furthermore, the image forming device 1 of the present embodiment includes a two-side conveyance route 90 as illustrated in FIG. 1. The two-side conveyance route 90 is adapted to convey the sheet S that has once passed the image forming route 80 to the image forming route 80 again. This enables the image forming device 1 to perform two-side printing in which images are formed on both sides of the sheet S. Meanwhile, all of the sheet feeding routes 50, 60, 70, image forming route 80, and two-side conveyance route 90 are the conveyance routes to convey the sheet S. Furthermore, a plurality of conveyance rollers to convey the sheet S is provided besides the registration roller 81 on the conveyance routes. Additionally, a conveyance unit to convey the sheet S along the conveyance routes by these conveyance rollers is formed.

Figure 2:
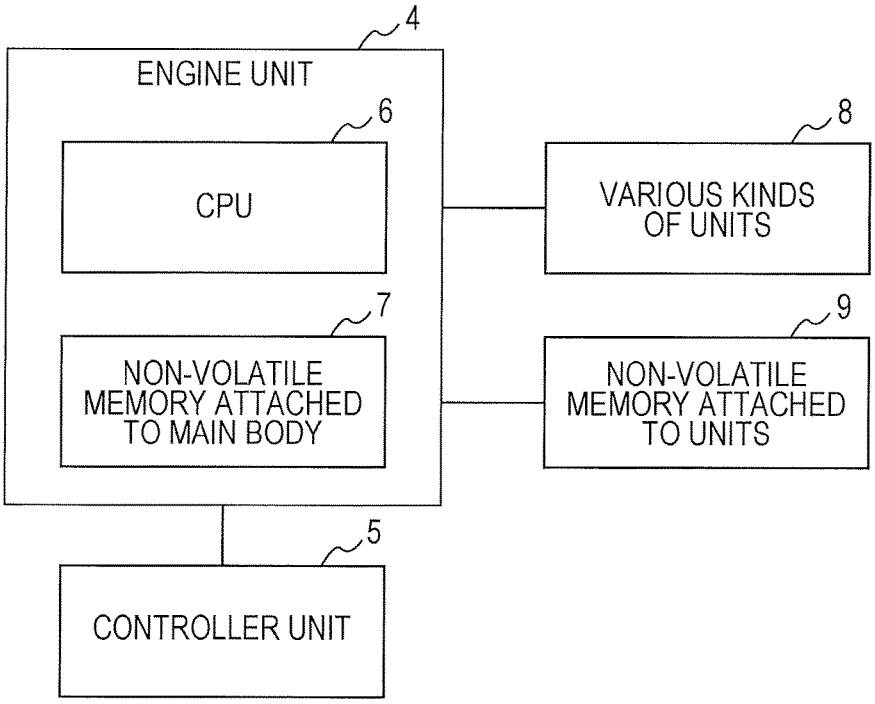
FIG. 2 is a schematic diagram illustrating a control configuration of the image forming device according to the embodiment.

FIG. 2 is a diagram schematically illustrating a control configuration of the image forming device 1. The image forming device 1 includes an engine unit 4 and a controller unit 5 in order to control respective units. The engine unit 4 includes a CPU 6 to perform general control processing and a non-volatile memory 7 attached to a main body.

The non-volatile memory 7 stores, for example, various kinds of values in order to form an appropriate image by the image forming device 1. For example, values such as a rotation speed of the roller 31, a rotation speed of each of the photoconductors 11, and a conveyance speed of the sheet S are stored.

The CPU 6 controls the respective units of the image forming device 1 based on the values stored in the non-volatile memory 7. For example, a color toner image is formed on the intermediate transfer belt 30 without deviation by adjusting timing to start forming an electrostatic latent image by each exposure device 13. Additionally, the timing to start forming an electrostatic latent image by each exposure device 13 and timing to start feeding the sheet S from the sheet feeding unit 3 are adjusted. Consequently, control is performed such that timing of the sheet S entering the secondary transfer nip N1 coincides with timing of the toner image formed on the intermediate transfer belt 30 entering the secondary transfer nip N1.

Furthermore, at the time of feeding the sheet S from the sheet feeding unit 3, the CPU 6 determines which one of the first sheet feeding roller 52, the second sheet feeding roller 62, and the third sheet feeding roller 72 to perform sending operation, and causes the determined sheet feeding roller to perform the sending operation. Therefore, power supply to the motor 100 and the direction of rotational drive thereof are controlled. Additionally, ON/OFF control of power supply to an electromagnetic clutch described later can be performed as well.

Furthermore, the engine unit 4 controls various kinds of units 8 included in the image forming device 1, and further performs writing and reading relative to a non-volatile memory 9 attached to the various kinds of units. The various kinds of units 8 include, for example, a toner bottle, an imaging unit, and the like. Additionally, the non-volatile memory 9 attached the various kinds of units includes, for example, a memory attached the toner bottle, a memory attached the imaging unit, and the like. Furthermore, for example, the memory attached to the toner bottle stores a toner residual amount and the like, and the memory attached the imaging unit stores the number of printing sheets and the like.

Additionally, the controller unit 5 is connected to an external personal computer and the like, and adapted to receive a command input. For example, by receiving an image forming command from the personal computer, an image forming job is generated in the image forming device 1. Furthermore, various information such as a dot counter value is exchanged between the engine unit 4 and the controller unit 5.

Next, an exemplary normal image forming operation by the image forming device 1 of the present embodiment will be briefly described. In the following description, provided is the exemplary image forming operation in a color mode in which a color image is formed on a sheet S stored in the first storage unit 51 by using toner of four colors.

At the time of forming a normal color image, first the intermediate transfer belt 30 and the photoconductor 11 of each color are respectively rotated at a predetermined circumferential speed in a direction indicated by the arrows in FIG. 1. Then, the outer peripheral surface of each of the photoconductor 11 is substantially uniformly charged by the charging device 12. The charged outer peripheral surface of the photoconductor 11 is irradiated with light according to image data by the exposure device 13.

Subsequently, an electrostatic latent image is developed by the developing device 14, and a toner image is formed on the photoconductor 11. The toner image of each color is transferred onto the intermediate transfer belt 30 at the primary transfer nip formed by the photoconductor 11 and the intermediate transfer belt 30 (primary transfer). More specifically, the toner images of yellow (Y), magenta (M), cyan (C), black (K) are superimposed in this order on the intermediate transfer belt 30.

Furthermore, transfer residual toner not transferred to the intermediate transfer belt 30 and remaining on the photoconductor 11 after passing the primary transfer roller 15 is scraped by the photoconductor cleaner 16 and removed from above the photoconductor 11. Then, the superimposed toner images of the four colors are conveyed to the secondary transfer nip N1 by rotation of the intermediate transfer belt 30.

On the other hand, the sheets S stored in the first storage unit 51 are pulled out to the sheet feeding route 50 one by one from the topmost sheet by the sending operation of the first sheet feeding roller 52. The sheet S pulled out is conveyed to the secondary transfer nip N1 along the sheet feeding route 50 and the image forming route 80. Precise adjustment is performed by the registration roller 81 such that the timing of the sheet S entering the secondary transfer nip N1 coincides with the timing of the toner image formed on the intermediate transfer belt 30 entering the secondary transfer nip N1. Consequently, the superimposed toner images of four colors are transferred to the sheet S at the secondary transfer nip N1 (secondary transfer).

The sheet S onto which the toner images are transferred is conveyed to the downstream side of the image forming route 80. In other words, the sheet S is ejected to the sheet ejection unit 84 by the sheet ejection roller 83 after the toner images are fixed by the fixing device 82. Meanwhile, the transfer residual toner remaining on the intermediate transfer belt 30 even after passing the secondary transfer nip N1 is collected by the belt cleaner 41. Consequently, the remaining toner is removed from the intermediate transfer belt 30.

Meanwhile, in the case of performing two-side printing, the sheet S having a first surface formed with an image by passing the image forming route 80 is conveyed to the two-side conveyance route 90 by the sheet ejection roller 83. Consequently, one side of the sheet S is reversed to the other relative to the conveyance direction. Then, the sheet S having passed the two-side conveyance route 90 is again conveyed to the image forming route 80 by the registration roller 81. Consequently, an image can be formed on a second surface on the opposite side of the first side of the sheet S. In this manner, the sheet S having the two sides formed with the images is ejected to the sheet ejection unit 84.

Figure 3:
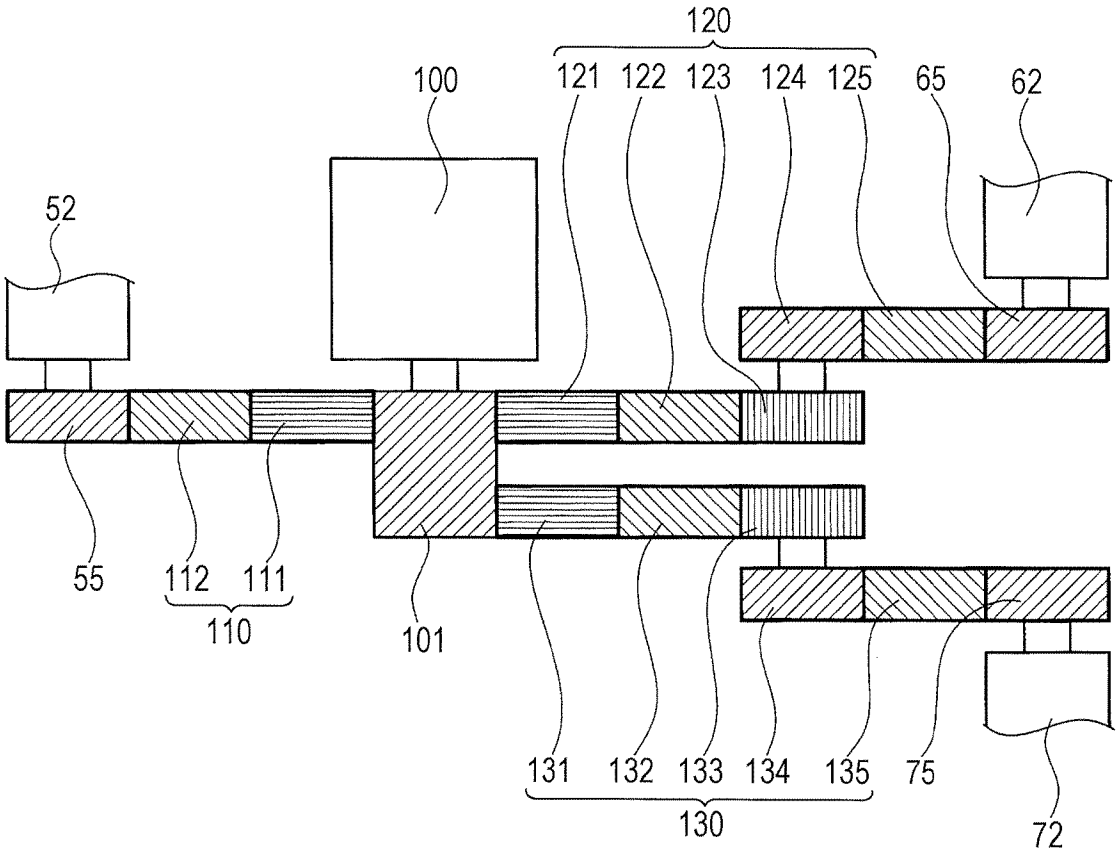
FIG. 3 is a schematic structural diagram illustrating respective drive transmission systems according to a first embodiment.

Next, the drive transmission system to connect the motor 100 to the first sheet feeding roller 52, second sheet feeding roller 62, and third sheet feeding roller 72 will be described. FIG. 3 is a schematic structural diagram illustrating the drive transmission systems adapted to connect the motor 100 to the first sheet feeding roller 52, second sheet feeding roller 62, and third sheet feeding roller 72 respectively.

As illustrated in FIG. 3, the first sheet feeding roller 52, second sheet feeding roller 62, and third sheet feeding roller 72 include a first roller end gear 55, a second roller end gear 65, and third roller end gear 75 respectively in each of axial ends thereof. Further, the motor 100 includes a motor gear 101 at an end of a motor shaft.

The first roller end gear 55 of the first sheet feeding roller 52 is connected to the motor gear 101 of the motor 100 via a first drive transmission system 110. Furthermore, the second roller end gear 65 of the second sheet feeding roller 62 is connected to the motor gear 101 of the motor 100 via a second drive transmission system 120. Moreover, the third roller end gear 75 of the third sheet feeding roller 72 is connected to the motor gear 101 of the motor 100 via a third drive transmission system 130.

The first drive transmission system 110 is formed of a first one-way clutch 111 and an idle gear 112. Therefore, the first sheet feeding roller 52 is connected to the motor 100 via the first one-way clutch 111 and the idle gear 112. Both the first one-way clutch 111 and the idle gear 112 are mechanical elements to transmit drive force of the motor 100 to the first sheet feeding roller 52.

The first one-way clutch 111 is connected only when the motor 100 is rotationally driven in a first direction, and the first one-way clutch 111 becomes a disconnected state when the motor 100 is rotationally driven in a second direction. Therefore, the first one-way clutch 111 can transmit drive force generated by the motor 100 to the idle gear 112 only when the motor 100 is rotationally driven in the first direction.

The second drive transmission system 120 is formed of a second one-way clutch 121, an idle gear 122, a first electromagnetic clutch 123, a first electromagnetic clutch gear 124, and an idle gear 125. Therefore, the second sheet feeding roller 62 is connected to the motor 100 via the second one-way clutch 121, idle gear 122, first electromagnetic clutch 123, first electromagnetic clutch gear 124, and idle gear 125. All of the second one-way clutch 121, idle gear 122, first electromagnetic clutch 123, first electromagnetic clutch gear 124, and idle gear 125 are mechanical elements to transmit drive force of the motor 100 to the second sheet feeding roller 62.

The second one-way clutch 121 is connected only when the motor 100 is rotationally driven in the second direction, and the second one-way clutch 121 becomes a disconnected state when the motor 100 is rotationally driven in the first direction. Therefore, the second one-way clutch 121 can transmit drive force generated by the motor 100 to the idle gear 122 only when the motor 100 is rotationally driven in the second direction.

In the second drive transmission system 120, the first electromagnetic clutch 123 is located more on the second sheet feeding roller 62 side than the second one-way clutch 121 is. The first electromagnetic clutch 123 is connected or disconnected by turning on/off power supply. Meanwhile, the first electromagnetic clutch 123 of the present embodiment is connected in an ON state in which current flows in an exciting coil, and the first electromagnetic clutch 123 is disconnected in an OFF state in which current does not flow in the exciting coil.

Furthermore, when connected, the first electromagnetic clutch 123 is in a transmission state in which drive force can be transmitted, and when disconnected, the first electromagnetic clutch 123 is in an interruption state in which drive force is not transmitted. Therefore, the first electromagnetic clutch 123 can transmit, to the first electromagnetic clutch gear 124, drive force transmitted to the idle gear 122 only in the transmission state.

The third drive transmission system 130 is formed of a third one-way clutch 131, an idle gear 132, a second electromagnetic clutch 133, a second electromagnetic clutch gear 134, and an idle gear 135. Therefore, the third sheet feeding roller 72 is connected to the motor 100 via the third one-way clutch 131, idle gear 132, second electromagnetic clutch 133, second electromagnetic clutch gear 134, and idle gear 135. All of the third one-way clutch 131, idle gear 132, second electromagnetic clutch 133, second electromagnetic clutch gear 134, and idle gear 135 are mechanical elements to transmit drive force of the motor 100 to the third sheet feeding roller 72.

The third one-way clutch 131 is connected only when the motor 100 is rotationally driven in the second direction, and the third one-way clutch 131 becomes the disconnected state when the motor 100 is rotationally driven in the first direction. Therefore, the third one-way clutch 131 can transmit drive force generated by the motor 100 to the idle gear 132 only when the motor 100 is rotationally driven in the second direction.

In the third drive transmission system 130, the second electromagnetic clutch 133 is located more on the third sheet feeding roller 72 side than the third one-way clutch 131 is. The second electromagnetic clutch 133 is connected or disconnected by turning on/off power supply. Meanwhile, the second electromagnetic clutch 133 of the present embodiment is connected in the ON state in which current flows in the exciting coil, and the second electromagnetic clutch 133 is disconnected in the OFF state in which current does not flow in the exciting coil in the same manner as the first electromagnetic clutch 123.

Furthermore, when connected, the second electromagnetic clutch 133 is in the transmission state in which drive force can be transmitted, and when disconnected, the second electromagnetic clutch 133 is in the interruption state in which drive force is not transmitted. Therefore, the second electromagnetic clutch 133 can transmit, to the second electromagnetic clutch gear 134, drive force transmitted to the idle gear 132 only in the transmission state.

Figure 6:
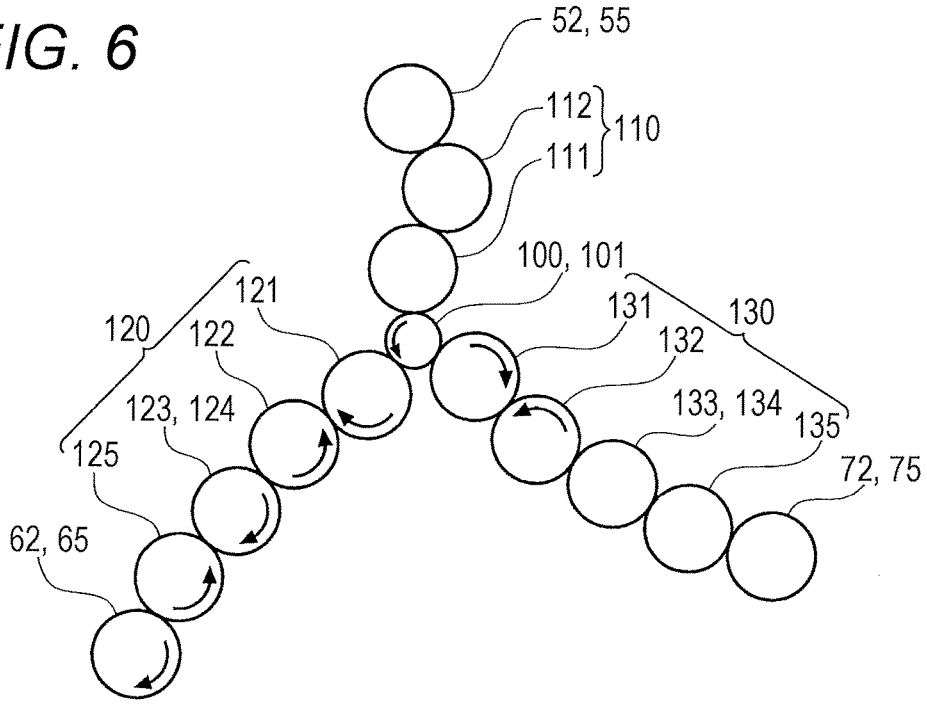
FIG. 6 is a diagram illustrating a drive force transmission state at the time of making a second sheet feeding roller perform the sending operation in each drive transmission system according to the first embodiment.
Figure 7:
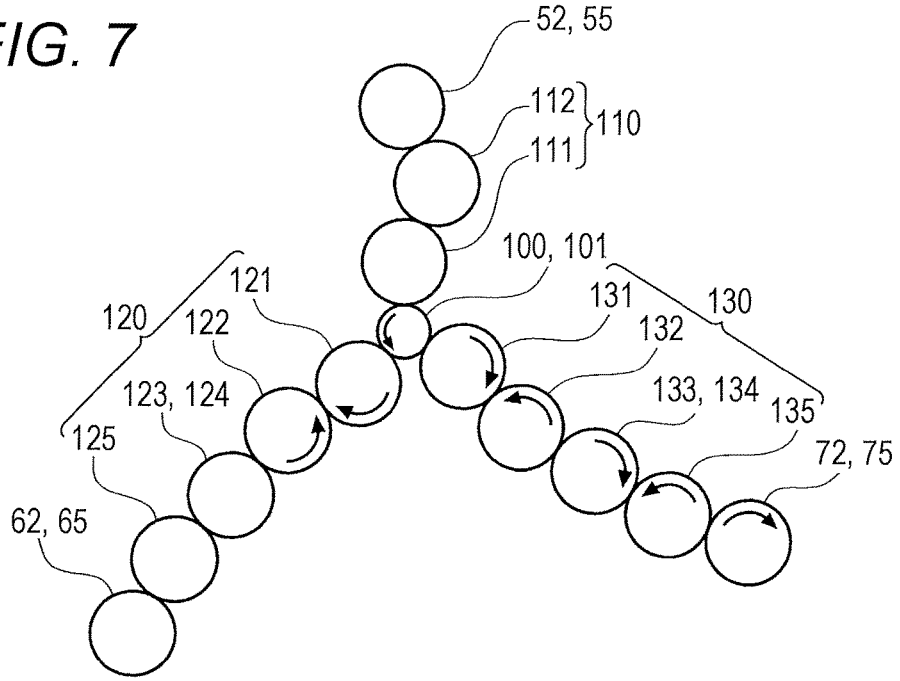
FIG. 7 is a diagram illustrating a drive force transmission state at the time of making a third sheet feeding roller perform the sending operation in each drive transmission system according to the first embodiment.

FIG. 4 is a table illustrating control processing for the motor and the electromagnetic clutches by the CPU 6 at the time of making the first sheet feeding roller 52, second sheet feeding roller 62, and third sheet feeding roller 72 perform the sending operation respectively. Furthermore, FIGS. 5, 6, and 7 are diagrams illustrating drive force transmission states in the respective drive transmission systems at the time of making the first sheet feeding roller 52, second sheet feeding roller 62, and third sheet feeding roller 72 perform the sending operation respectively.

Figure 5:
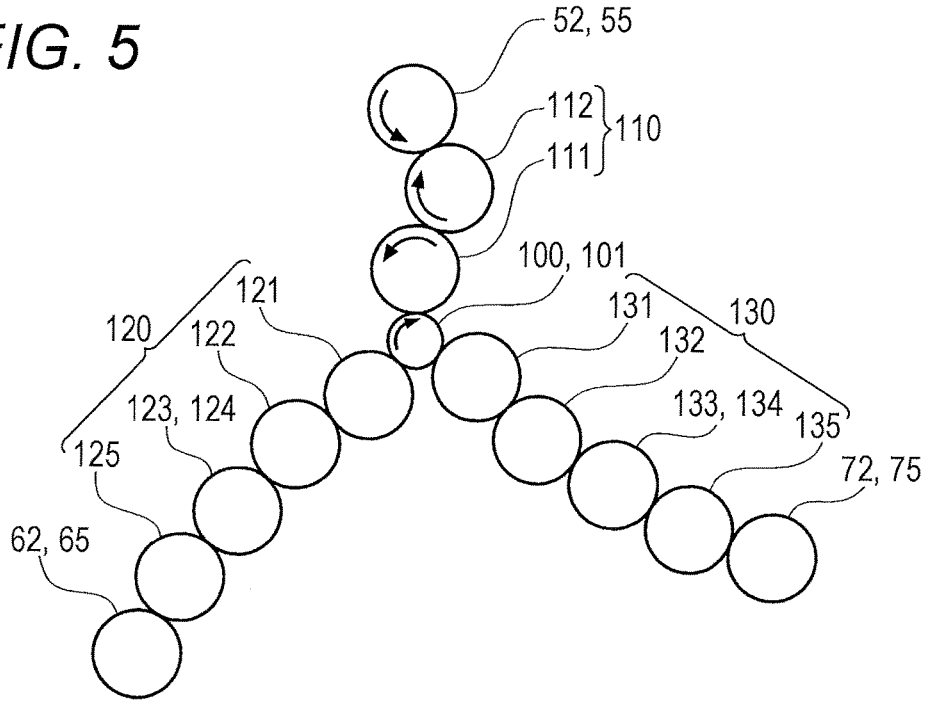
FIG. 5 is a diagram illustrating a drive force transmission state at the time of making a first sheet feeding roller perform the sending operation in the respective drive transmission systems according to the first embodiment.

More specifically, FIG. 5 is the diagram illustrating the drive force transmission state in the first drive transmission system 110, second drive transmission system 120, and third drive transmission system 130 at the time of making the first sheet feeding roller 52 perform the sending operation. FIG. 6 is the diagram illustrating the drive force transmission state in the first drive transmission system 110, second drive transmission system 120, and third drive transmission system 130 at the time of making the second sheet feeding roller 62 perform the sending operation. FIG. 7 is the diagram illustrating the drive force transmission state in the first drive transmission system 110, second drive transmission system 120, and third drive transmission system 130 at the time of making the third sheet feeding roller 72 perform the sending operation.

First, a description will be provided for a case of making the first sheet feeding roller 52 perform the sending operation. At the time of making the first sheet feeding roller 52 perform the sending operation, the CPU 6 rotationally drives the motor 100 in the first direction as illustrated in FIG. 4. Consequently, the first one-way clutch 111 is connected. On the other hand, since the motor 100 is rotated in the first direction, both the second one-way clutch 121 and the third one-way clutch 131 are disconnected. Furthermore, at the time of making the first sheet feeding roller 52 perform the sending operation, the CPU 6 disconnects both the first electromagnetic clutch 123 and the second electromagnetic clutch 133, and sets these electromagnetic clutches in the interruption state.

Therefore, at the time of making the first sheet feeding roller 52 perform the sending operation, drive force generated by the motor 100 rotationally driven in the first direction is transmitted to the idle gear 112 by the connected first one-way clutch 111 as illustrated in FIG. 5. Then, the drive force transmitted to the idle gear 112 is transmitted to the first roller end gear 55, and the first sheet feeding roller 52 is rotated. Consequently, the first sheet feeding roller 52 performs the sending operation.

Meanwhile, at the time of making the first sheet feeding roller 52 perform the sending operation, the drive force generated by the motor 100 rotationally driven in the first direction is prevented from being transmitted to the idle gear 122 by the disconnected second one-way clutch 121 as illustrated in FIG. 5. Furthermore, at the time of making the first sheet feeding roller 52 perform the sending operation, the drive force generated by the motor 100 rotationally driven in the first direction is prevented from being transmitted to the idle gear 132 by the disconnected third one-way clutch 131 as illustrated in FIG. 5. Therefore, when the first sheet feeding roller 52 performs the sending operation, the second sheet feeding roller 62 and the third sheet feeding roller 72 are prevented from being rotated.

Next, a description will be provided for a case of making the second sheet feeding roller 62 perform the sending operation. At the time of making the second sheet feeding roller 62 perform the sending operation, the CPU 6 rotationally drives the motor 100 in the second direction as illustrated in FIG. 4. Consequently, both the second one-way clutch 121 and the third one-way clutch 131 are connected. On the other hand, since the motor 100 is rotated in the second direction, the first one-way clutch 111 is disconnected. Furthermore, at the time of making the second sheet feeding roller 62 perform the sending operation, the CPU 6 connects the first electromagnetic clutch 123 and sets the same in the transmission state. On the other hand, CPU 6 disconnects the second electromagnetic clutch 133 and sets the same in the interruption state.

Therefore, at the time of making the second sheet feeding roller 62 perform the sending operation, the drive force generated by the motor 100 rotationally driven in the second direction is transmitted to the idle gear 122 by the connected second one-way clutch 121 as illustrated in FIG. 6. Furthermore, the drive force transmitted to the idle gear 122 is transmitted to the first electromagnetic clutch gear 124 by the first electromagnetic clutch 123 in the transmission state. Then, the drive force transmitted to the first electromagnetic clutch gear 124 is transmitted to the idle gear 125 and the second roller end gear 65, and the second sheet feeding roller 62 is rotated. Consequently, the second sheet feeding roller 62 performs the sending operation.

Meanwhile, at the time of making the second sheet feeding roller 62 perform the sending operation, the drive force generated by the motor 100 rotationally driven in the second direction is prevented from being transmitted to the idle gear 112 by the disconnected first one-way clutch 111 as illustrated in FIG. 6. On the other hand, the drive force generated by the motor 100 rotationally driven in the second direction is transmitted to the idle gear 132 by the connected third one-way clutch 131. However, the drive force transmitted by the idle gear 132 is prevented from being transmitted to the second electromagnetic clutch gear 134 because the second electromagnetic clutch 133 is in the interruption state. Therefore, when the second sheet feeding roller 62 performs the sending operation, the first sheet feeding roller 52 and the third sheet feeding roller 72 are prevented from being rotated.

Next, a description will be provided for a case of making the third sheet feeding roller 72 perform the sending operation. At the time of making the third sheet feeding roller 72 perform the sending operation, the CPU 6 rotationally drives the motor 100 in the second direction as illustrated in FIG. 4. Consequently, both the second one-way clutch 121 and the third one-way clutch 131 are connected. On the other hand, since the motor 100 is rotated in the second direction, the first one-way clutch 111 is disconnected. Furthermore, at the time of making the second sheet feeding roller 62 perform the sending operation, the CPU 6 disconnects the first electromagnetic clutch 123 and sets the same in the interruption state. On the other hand, the CPU 6 connects the second electromagnetic clutch 133 and sets the same in the transmission state.

Therefore, at the time of making the third sheet feeding roller 72 perform the sending operation, the drive force generated by the motor 100 rotationally driven in the second direction is transmitted to the idle gear 132 by the connected third one-way clutch 131 as illustrated in FIG. 7. Furthermore, the drive force transmitted to the idle gear 132 is transmitted to the second electromagnetic clutch gear 134 by the second electromagnetic clutch 133 in the transmission state. Then, the drive force transmitted to the second electromagnetic clutch gear 134 is transmitted to the idle gear 135 and the third roller end gear 75, and the third sheet feeding roller 72 is rotated. Consequently, the third sheet feeding roller 72 performs the sending operation.

Meanwhile, at the time of making the third sheet feeding roller 72 perform the sending operation, the drive force generated by the motor 100 rotationally driven in the second direction is prevented from being transmitted to the idle gear 112 by the disconnected first one-way clutch 111 as illustrated in FIG. 7. On the other hand, the drive force generated by the motor 100 rotationally driven in the second direction is transmitted to the idle gear 122 by the connected second one-way clutch 121. However, the drive force transmitted to the idle gear 122 is prevented from being transmitted to the first electromagnetic clutch gear 124 because the first electromagnetic clutch 123 is in the interruption state. Therefore, when the third sheet feeding roller 72 performs the sending operation, the first sheet feeding roller 52 and the second sheet feeding roller 62 are prevented from being rotated.

Thus, in the image forming device 1 of the present embodiment, only the sheet feeding roller which performs the sending operation for the sheet S used for image forming is rotationally driven by the motor 100 at the time of image forming out of the first sheet feeding roller 52, second sheet feeding roller 62, and third sheet feeding roller 72.

Here, in the image forming device 1 of the present embodiment, when the first sheet feeding roller 52 performs the sending operation, drive force is prevented from being transmitted to the first electromagnetic clutch 123 of the second drive transmission system 120 and the second electromagnetic clutch 133 of the third drive transmission system 130. The reason is that transmission of the drive force is interrupted by the second one-way clutch 121 provided more on the motor 100 side than the first electromagnetic clutch 123 is in the second drive transmission system 120. Also, the reason is that transmission of the drive force is interrupted by the third one-way clutch 131 provided more on the motor 100 side than the second electromagnetic clutch 133 is in the third drive transmission system 130.

Therefore, while the first sheet feeding roller 52 performs the sending operation, sliding sound is prevented from being generated by the first electromagnetic clutch 123 and the second electromagnetic clutch 133 which generate noisy sliding sound at the time of idling in the interrupted state. Consequently, in the image forming device 1 of the present embodiment, sound generated from the sheet feeding unit 3 is reduced in the case of forming an image on a sheet S stored in the first storage unit 51.

Meanwhile, in order to reduce the sound generated from the sheet feeding unit 3, it is preferable to prescribe, in an instruction manual of the image forming device 1, that a sheet S used with high frequency at the time of image forming is stored in the first storage unit 51, for example. Otherwise, in the case where the image forming device 1 includes a display panel, it is preferable to display, on the display panel, that the sheet S used with high frequency at the time of image forming is stored in the first storage unit 51, for example.

Furthermore, in the image forming device 1 of the present embodiment, the sheet feeding route 50 is formed shorter than any one of the sheet feeding route 60 and the sheet feeding route 70. More specifically, a distance from the first storage unit 51 to the secondary transfer nip N1 on the conveyance route along which the sheet S is conveyed is shorter than distances to the secondary transfer nip N1 from any one of the second storage unit 61 and the third storage unit 71. Consequently, the image forming device 1 can form an image on the sheet S stored in the first storage unit 51 in a shortest time.

Therefore, a user stores, in the first storage unit 51, the sheet S used with highest frequency at the time of image forming, thereby enabling the image forming device 1 to form an image with high productivity on the sheet S used with the highest frequency. Furthermore, in the image forming device 1 of the present embodiment, since the sheet S used with the highest frequency at the time of image forming is stored in the first storage unit 51, the sound generated from the sheet feeding unit 3 is reduced at the time of forming an image on the sheet S used with the high frequency. More specifically, in the image forming device 1 of the present embodiment, image forming performed with the high frequency can be performed quietly with high productivity.

Furthermore, in the image forming device 1 of the present embodiment, the first drive transmission system 110 is formed of the less number of mechanical elements than the second drive transmission system 120 and the third drive transmission system 130 are. Meanwhile, due to this, the motor 100 is arranged at a position closer to the first sheet feeding roller 52 than any one of the second sheet feeding roller 62 and the third sheet feeding roller 72 are in the image forming device 1 of the present embodiment. Furthermore, the fewer the number of mechanical elements to transmit drive force is, the less the sound generated from the sheet feeding unit 3 is. Consequently, in the image forming device 1 of the present embodiment, the sound generated from the sheet feeding unit 3 is more reduced in the case of forming an image on the sheet S stored in the first storage unit 51.

Moreover, in the present embodiment, the second one-way clutch 121 is arranged at a position closest to the motor 100 in the second drive transmission system 120. In the third drive transmission system 130 also, the third one-way clutch 131 is arranged on a side closest to the motor 100 side. Therefore, in the image forming device 1, when the first sheet feeding roller 52 performs the sending operation, transmission routes of drive force in the second drive transmission system 120 and the third drive transmission system 130 are interrupted at the positions closest to the motor 100. Consequently, when the first sheet feeding roller 52 performs the sending operation, the number of mechanical elements to transmit drive force in the second drive transmission system 120 and the third drive transmission system 130 is minimized. Therefore, in the image forming device 1 of the present embodiment, the sound generated from the sheet feeding unit 3 is more reduced in the case of forming an image on the sheet S stored in the first storage unit 51.

Furthermore, in the present embodiment, the first one-way clutch 111 is arranged at a position closest to the motor 100 in the first drive transmission system 110. Therefore, in the image forming device 1, when the second sheet feeding roller 62 or the third sheet feeding roller 72 performs the sending operation, the transmission route of drive force in the first drive transmission system 110 is interrupted at a position closest to the motor 100. Consequently, when the second sheet feeding roller 62 or the third sheet feeding roller 72 performs the sending operation, the number of mechanical elements to transmit drive force in the first drive transmission system 110 is minimized. Therefore, in the image forming device 1 of the present embodiment, sound generated from the sheet feeding unit 3 is reduced also in the case of forming an image on a sheet S stored in the second storage unit 61 or the third storage unit 71.

Furthermore, generally a sheet S used with not so high frequency at the time of image forming tends to be stored in the manual feed tray. In other words, the manual feed tray tends to be used to store special sheets S such as an embossed sheet, an OHP sheet, and an envelope, and image forming using the sheets S in the manual feed tray is likely to be used with low frequency. On the other hand, a sheet S that tends to be used with high frequency at the time of image forming, such as an A4 size recycled paper, is likely to be stored in a storage unit provided inside the device such as a sheet feeding cassette.

More specifically, like the present embodiment, in the image forming device 1 including the first storage unit 51 that is the sheet feeding cassette and the third storage unit 71 that is the manual feed tray, the sheet S used with high frequency at the time of image forming is likely to be stored more in the first storage unit 51 than the third storage unit 71. Therefore, in the image forming device 1 of the present embodiment, image forming performed with high frequency can be performed quietly with high productivity.

Furthermore, in the case where a sheet S of the same type as the sheet S stored in the first storage unit 51 is stored in at least one of the second storage unit 61 and the third storage unit 71, preferably the CPU 6 makes the first sheet feeding roller 52 preferentially perform the sending operation. More specifically, for example, in the case where sheet S that is the same type as a sheet S used in image forming is stored in both of the first storage unit 51 and the second storage unit 61, preferably, the first sheet feeding roller 52 is made to perform preferentially the sending operation. The reason is that image forming can be performed while reducing the sound generated from the sheet feeding unit 3. In this case, it is only to provide a sheet type output unit adapted to output a type of a sheet S stored in each of the first storage unit 51, second storage unit 61, and third storage unit 71.

Furthermore, a sheet type input unit in which the user inputs a type of the sheet S stored in each of the first storage unit 51, second storage unit 61, and third storage unit 71 may be provided, and the sheet type output unit is only to output the sheet type input therein. Otherwise, a sheet type detection unit adapted to detect a type of a stored sheet S may be provided in each of the first storage unit 51, second storage unit 61, and third storage unit 71, and a detected type may be output.

As described in detail above, the image forming device 1 of the present embodiment includes the first sheet feeding roller 52, second sheet feeding roller 62, and third sheet feeding roller 72 to perform the sending operation for a sheet S stored in each of the first storage unit 51, second storage unit 61, and third storage unit 71. The drive source of the first sheet feeding roller 52, second sheet feeding roller 62, and third sheet feeding roller 72 is only one, the motor 100. Furthermore, the first drive transmission system 110 adapted to connect the first sheet feeding roller 52 to the motor 100 includes the first one-way clutch 111 that transmits drive force only when the motor 100 is rotationally driven in the first direction. The second drive transmission system 120 adapted to connect the second sheet feeding roller 62 to the motor 100 includes the second one-way clutch 121 and the first electromagnetic clutch 123 which transmit only drive force when the motor 100 is rotationally driven in the second direction. The first electromagnetic clutch 123 is arranged more on the second sheet feeding roller 62 side than the second one-way clutch 121 is in the second drive transmission system 120. The third drive transmission system 130 adapted to connect the third sheet feeding roller 72 to the motor 100 includes the third one-way clutch 131 and the second electromagnetic clutch 133 which transmit only drive force when the motor 100 is rotationally driven in the second direction. The second electromagnetic clutch 133 is arranged more on the third sheet feeding roller 72 side than the third one-way clutch 131 is in the third drive transmission system 130. Then, at the time of making the first sheet feeding roller 52 perform the sending operation, the CPU 6 rotationally drives the motor 100 in the first direction. Consequently, the inexpensive and compact image forming device in which the sound generated with the sending operation is reduced is implemented.

Second Embodiment

Next, a second embodiment will be described. In the present embodiment, a structure of a drive transmission system is different from that of a first embodiment. Other structures excluding the structure of the drive transmission system are the same as the first embodiment.

Figure 8:
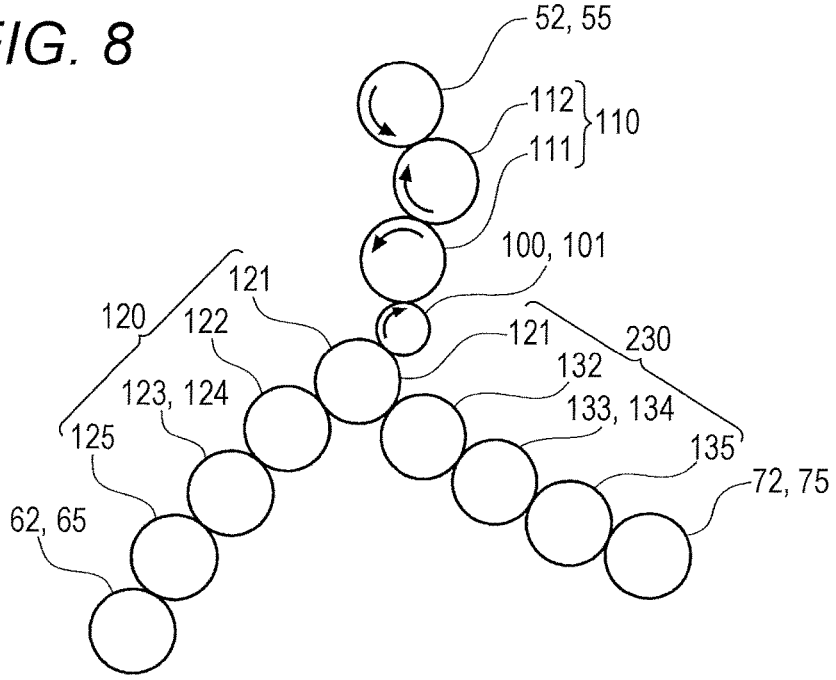
FIG. 8 is a diagram illustrating a drive force transmission state at the time of making a first sheet feeding roller perform sending operation in respective transmission systems according to a second embodiment.
Figure 9:
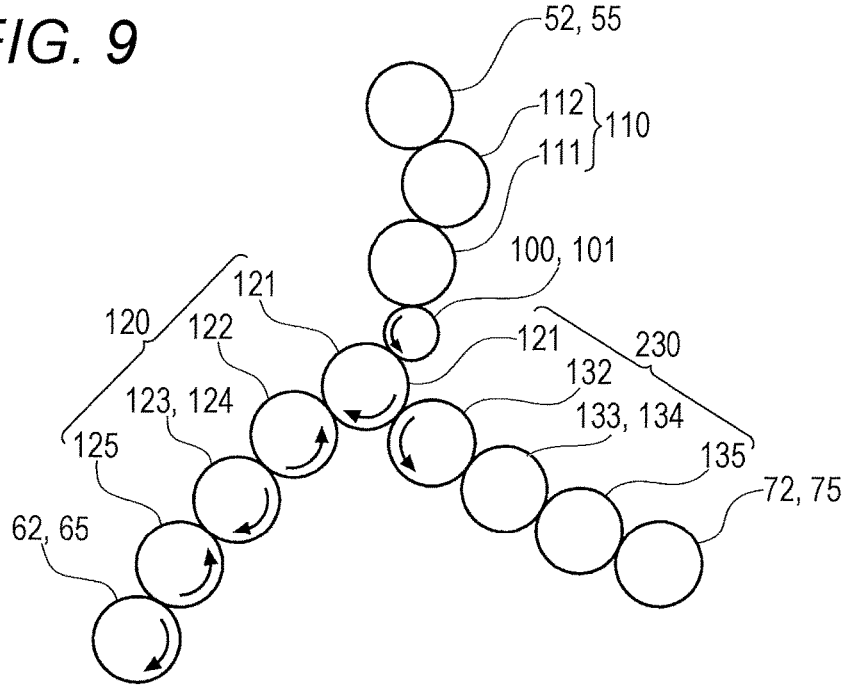
FIG. 9 is a diagram illustrating a drive force transmission state at the time of making a second sheet feeding roller perform the sending operation in the respective drive transmission systems according to the second embodiment.
Figure 10:
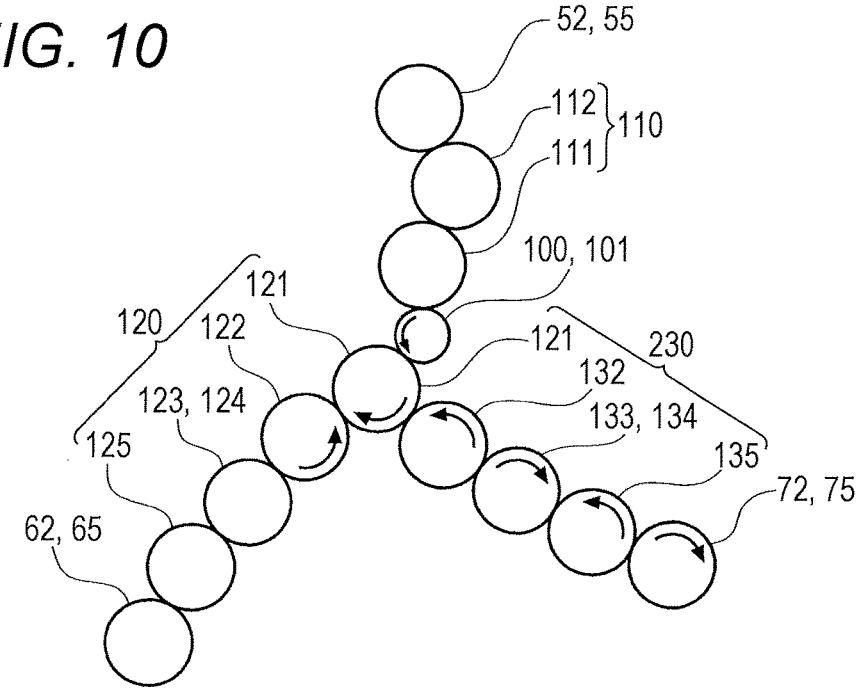
FIG. 10 is a diagram illustrating a drive force transmission state at the time of making a third sheet feeding roller perform sending operation in the respective drive transmission systems according to the second embodiment.

The present embodiment will be described by FIGS. 8, 9, and 10. FIGS. 8, 9, and 10 are diagrams illustrating transmission states of drive force in respective drive transmission systems at the time of making a first sheet feeding roller 52, a second sheet feeding roller 62, and a third sheet feeding roller 72 perform the sending operation respectively.

More specifically, FIG. 8 is the diagram illustrating the transmission state of drive force in a first drive transmission system 110, a second drive transmission system 120, and a third drive transmission system 230 at the time of making the first sheet feeding roller 52 perform the sending operation. FIG. 9 is the diagram illustrating the transmission state of drive force in the first drive transmission system. 110, second drive transmission system 120, and third drive transmission system 230 at the time of making the second sheet feeding roller 62 perform the sending operation. FIG. 10 is the diagram illustrating the transmission state of drive force in the first drive transmission system 110, second drive transmission system 120, and third drive transmission system 230 at the time of making the third sheet feeding roller 72 perform the sending operation.

Additionally, as illustrated in FIGS. 8, 9, and 10, a structure of the third drive transmission system 230 differs from that of the first embodiment. More specifically, in the present embodiment, a one-way clutch of the third drive transmission system 230 is commonly used as a second one-way clutch 121 of the second drive transmission system 120. Therefore, the third drive transmission system 230 is formed of the second one-way clutch 121, an idle gear 132, a second electromagnetic clutch 133, a second electromagnetic clutch gear 134, and an idle gear 135. Meanwhile, structures of the first drive transmission system 110 and the second drive transmission system 120 are the same as the first embodiment.

Furthermore, in the present embodiment, a CPU 6 controls a motor and an electromagnetic clutch as shown in a table in FIG. 4 same as the first embodiment at the time of making the first sheet feeding roller 52, second sheet feeding roller 62, and third sheet feeding roller 72 perform the sending operation respectively.

Therefore, at the time of making the first sheet feeding roller 52 perform the sending operation, drive force generated by a motor 100 rotationally driven in a first direction is transmitted to an idle gear 112 by a connected first one-way clutch 111 as shown in FIG. 8. Then, the drive force transmitted to the idle gear 112 is transmitted to a first roller end gear 55, and the first sheet feeding roller 52 is rotated. Consequently, the first sheet feeding roller 52 performs the sending operation.

Meanwhile, at the time of making the first sheet feeding roller 52 perform the sending operation, the drive force generated by the motor 100 rotationally driven in the first direction is prevented from being transmitted to idle gears 122, 132 by the disconnected second one-way clutch 121 as illustrated in FIG. 8. Therefore, when the first sheet feeding roller 52 performs the sending operation, the second sheet feeding roller 62 and the third sheet feeding roller 72 are prevented from being rotated.

Furthermore, at the time of making the second sheet feeding roller 62 perform the sending operation, the drive force generated by the motor 100 rotationally driven in the second direction is transmitted to the idle gear 122 by the connected second one-way clutch 121 as illustrated in FIG. 9. Furthermore, the drive force transmitted to the idle gear 122 is transmitted to the first electromagnetic clutch gear 124 by the first electromagnetic clutch 123 in the transmission state. Then, the drive force transmitted to the first electromagnetic clutch gear 124 is transmitted to the idle gear 125 and the second roller end gear 65, and the second sheet feeding roller 62 is rotated. Consequently, the second sheet feeding roller 62 performs the sending operation.

Meanwhile, at the time of making the second sheet feeding roller 62 perform the sending operation, the drive force generated by the motor 100 rotationally driven in the second direction is prevented from being transmitted to the idle gear 112 by the disconnected first one-way clutch 111 as illustrated in FIG. 9. On the other hand, the drive force generated by the motor 100 rotationally driven in the second direction is transmitted to the idle gear 132 by the connected second one-way clutch 121. However, the drive force transmitted by the idle gear 132 is prevented from being transmitted to the second electromagnetic clutch gear 134 because the second electromagnetic clutch 133 is in the interruption state. Therefore, when the second sheet feeding roller 62 performs the sending operation, the first sheet feeding roller 52 and the third sheet feeding roller 72 are prevented from being rotated.

Furthermore, at the time of making the third sheet feeding roller 72 perform the sending operation, drive force generated by the motor 100 rotationally driven in the second direction is transmitted to the idle gear 132 by the connected second one-way clutch 121 as illustrated in FIG. 10. Furthermore, the drive force transmitted to the idle gear 132 is transmitted to the second electromagnetic clutch gear 134 by the second electromagnetic clutch 133 in the transmission state. Then, the drive force transmitted to the second electromagnetic clutch gear 134 is transmitted to the idle gear 135 and a third roller end gear 75, and the third sheet feeding roller 72 is rotated. Consequently, the third sheet feeding roller 72 performs the sending operation.

Meanwhile, at the time of making the third sheet feeding roller 72 perform the sending operation, the drive force generated by the motor 100 rotationally driven in the second direction is prevented from being transmitted to the idle gear 112 by the disconnected first one-way clutch 111 as shown in FIG. 10. On the other hand, the drive force generated by the motor 100 rotationally driven in the second direction is transmitted to the idle gear 122 by the connected second one-way clutch 121. However, the drive force transmitted to the idle gear 122 is prevented from being transmitted to the first electromagnetic clutch gear 124 because the first electromagnetic clutch 123 is in the interruption state. Therefore, when the third sheet feeding roller 72 performs the sending operation, the first sheet feeding roller 52 and the second sheet feeding roller 62 are prevented from being rotated.

Thus, in the present embodiment also, only the sheet feeding roller which performs the sending operation for a sheet S used for image forming is rotationally driven by the motor 100 at the time of image forming out of the first sheet feeding roller 52, second sheet feeding roller 62, and third sheet feeding roller 72. Furthermore, in the present embodiment, the number of one-way clutches is fewer than the first embodiment. Therefore, the present embodiment is more inexpensive than the first embodiment. Furthermore, a space occupied by the third drive transmission system 230 can be formed smaller than the first embodiment. Moreover, since the number of the one-way clutches is few, sound generated with rotation thereof is reduced. Therefore, sound generated with the sending operation is more reduced than the first embodiment.

As described above, in the present embodiment, the one-way clutch of the third drive transmission system 230 is commonly used as the second one-way clutch 121 of the second drive transmission system 120. Consequently, the inexpensive and compact image forming device in which the sound generated with the sending operation is reduced is implemented.

Note that the present embodiments are merely examples and not intended to limit the present invention. Therefore, needless to mention, various kinds of improvement and modification can be made on the present invention without departing from the gist thereof. For example, in both embodiments described above, the image forming device including the three storage units in the sheet feeding unit has been described. However, for example, the sheet feeding unit may include the more number of storage units such as sheet feeding trays and manual feed trays. In other words, the present invention is applicable to the image forming device including at least three or more storage units. The reason is that the sound generated from the sheet feeding unit is reduced without change in the case of forming an image on a sheet S stored in the first storage unit.

Furthermore, in an image forming device including four or more storage units, a drive transmission system of a sheet feeding roller of an increased storage unit relative to the image forming device of the above-described embodiments may have the same structure as the second drive transmission system or the third drive transmission system in the above-described embodiments. The reason is that the sound generated from the sheet feeding unit is reduced in the same manner as the above-described embodiments in the case of forming an image on a sheet S stored in the first storage unit.

Furthermore, in the above-described embodiments, at the time of making the first sheet feeding roller perform the sending operation, both of the second electromagnetic clutch and the third electromagnetic clutch are in the disconnected state as shown in FIG. 4. However, at the time of making the first sheet feeding roller perform the sending operation, each of the second electromagnetic clutch and the third electromagnetic clutch may be in either the connected state or the disconnected state. The reason is that drive force is prevented from being transmitted to the second electromagnetic clutch and the third electromagnetic clutch at the time of making the first sheet feeding roller perform the sending operation.

Furthermore, in the above-described embodiments, the description has been given for the case of using the electromagnetic clutch which is connected in the ON state in which current flows in an exciting coil and is disconnected in the OFF state in which current does not flow in the exciting coil. However, as the electromagnetic clutch, it is also possible to use a component that is disconnected in the ON state in which current flows in the exciting coil and is connected in the OFF state in which current does not flow in the exciting coil.

Alternatively, in the second drive transmission system and the third drive transmission system, a solenoid actuator actuated by on/off operation of power supply can be used instead of the electromagnetic clutch. More specifically, for example, it is possible to have a structure in which a link mechanism actuated by the solenoid actuator is provided, and a state is switched between a transmission state in which gears are mutually engaged and an interruption state in which the gears are apart from each other by operating the link mechanism. Furthermore, the solenoid actuator may generate sound at the time of this switching operation. Moreover, the first sheet feeding roller can be made to perform sending operation without operating the solenoid actuator. Consequently, sound generation can be suppressed.

Furthermore, the number of the idle gears in the respective drive transmission systems in the above-described embodiments is merely example, and not limited to those described above. Moreover, in the above-described embodiments, the description has been given for the case where the gears are mainly used as the mechanical elements to transmit drive force in the respective drive transmission systems. However, for example, combination of a timing belt and a pulley or the like may also be used instead of the idle gear.

Additionally, the present invention is applicable to not only a color printer but also, for example, a monochrome printer and an image forming device adapted to receive and transmit a print job via a public line.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

a conveyance unit configured to convey a sheet along a conveyance route;

an image forming section configured to form an image on a sheet conveyed along the conveyance route;

a plurality of storage units configured to store a plurality of sheets in a loading manner; and a sheet feeding roller provided in each of the plurality of storage units and configured to perform sending operation to send, to the conveyance route, the sheets stored in the storage unit one by one at the time of image forming, wherein provided are:

one drive source configured to be rotated in a first direction or a second direction opposite to the first direction by receiving power supply, and generate drive force to rotationally drive the sheet feeding roller by own rotation of the drive source;

a first drive transmission system configured to connect the drive source to a first sheet feeding roller for a first storage unit out of the storage units by using a mechanical element that transmits drive force generated from the drive source, and as the mechanical element, including a first one-way clutch that transmits only drive force in the first direction of the drive source;

a second drive transmission system configured to connect the drive source to a second sheet feeding roller for a second storage unit out of the storage units by using the mechanical elements, and as the mechanical elements, including: a second one-way clutch that transmits only drive force in the second direction of the drive source; and a first transmission interrupting unit arranged more on the second sheet feeding roller side than the second one-way clutch is and configured to set a transmission state to transmit drive force or an interruption state not to transmit drive force by performing on/off operation of power supply;

a third drive transmission system configured to connect the drive source to a third sheet feeding roller for a third storage unit out of the storage units by using the mechanical element, and as the mechanical element, including: a third one-way clutch that transmits only drive force in the second direction of the drive source; and a second transmission interrupting unit arranged more on the third sheet feeding roller side than the third one-way clutch is and configured to set a transmission state to transmit drive force or an interruption state not to transmit drive force by performing on/off operation of power supply; and a control unit configured to determine the sheet feeding roller to perform the sending operation at the time of image forming and control the drive source, the first transmission interrupting unit, and the second transmission interrupting unit, and the control unit is configured to:

rotationally drive the drive source in the first direction at the time of making the first sheet feeding roller perform the sending operation;

rotationally drive the drive source in the second direction while setting the first transmission interrupting unit in the transmission state and setting the second transmission interrupting unit in the interruption state at the time of making the second sheet feeding roller perform the sending operation; and rotationally drive the drive source in the second direction while setting the first transmission interrupting unit in the interruption state and setting the second transmission interrupting unit in the transmission state at the time of making the third sheet feeding roller perform the sending operation.

2. The image forming device according to claim 1, wherein the first storage unit is arranged at a position in which a distance on the conveyance route to an image forming position where an image is formed on a sheet by the image forming section is shorter than distances to the image forming position from the second storage unit and the third storage unit.

3. The image forming device according to claim 1, wherein the first drive transmission system is formed of the less number of the mechanical elements than the second drive transmission system and the third drive transmission system are.

4. The image forming device according to claim 1, wherein the second one-way clutch of the second drive transmission system is arranged at a position closest to the drive source, and the third one-way clutch of the third drive transmission system is arranged at a position closest to the drive source.

5. The image forming device according to claim 1, wherein the first one-way clutch of the first drive transmission system is arranged at a position closest to the drive source.

6. The image forming device according to claim 1, wherein the third one-way clutch of the third drive transmission system is commonly used as the second one-way clutch of the second drive transmission system.

7. The image forming device according to claim 1, wherein the first storage unit is provided inside the device, and at least one of the second storage unit and the third storage unit is provided in a manner projecting outside the device.

8. The image forming device according to claim 1, comprising a sheet type output unit configured to output a type of a sheet stored in the first storage unit and a type of a sheet stored in at least one of the second storage unit and the third storage unit, wherein the control unit makes the first sheet feeding roller perform the sending operation when both a type of a sheet stored in the first storage unit and a type of a sheet stored in at least one of the second storage unit and the third storage unit output from the sheet type output unit are the same as a type of a sheet used in image forming.

* * * * *